US005820049A

United States Patent [19]

Atkinson et al.

[11] Patent Number: 5,820,049

[45] Date of Patent: Oct. 13, 1998

[54] RIGID PLASTIC DYE TUBE

[75] Inventors: Leon Eric Atkinson; Joseph Stanely Taylor, both of Asheboro, N.C.; Hans Nicolas Gilljam, Aachen-Soars, Germany

[73] Assignee: Technimark, Inc., Asheboro, N.C.

[21] Appl. No.: 780,848

[22] Filed: Jan. 9, 1997

[51] Int. Cl.[6] ..... B65H 75/20; D06F 17/00

[52] U.S. Cl. ..... 242/118.1; 242/118.31; 68/198

[58] Field of Search ..... 242/118.1, 118.11, 242/118.31, 118.32; 68/198, 189

[56] References Cited

U.S. PATENT DOCUMENTS

| | | | |
|---|---|---|---|
| 3,448,597 | 6/1969 | Livingstone | 68/198 |
| 3,647,156 | 3/1972 | Henning | 242/118.1 |
| 4,270,710 | 6/1981 | Ono | 68/198 X |
| 4,491,286 | 1/1985 | Nielsen | 68/198 X |
| 4,519,557 | 5/1985 | Newman | 242/118.3 X |
| 4,632,332 | 12/1986 | Newman | 242/118.32 X |
| 4,702,433 | 10/1987 | Gilljam et al. | 242/118.1 |

FOREIGN PATENT DOCUMENTS

| | | | |
|---|---|---|---|
| 2 659 309 | 9/1991 | France | 242/118.11 |

*Primary Examiner*—Michael Mansen
*Attorney, Agent, or Firm*—Rhodes, Coats & Bennett, L.L.P.

[57] ABSTRACT

A rigid plastic dye tube. The tube includes a pair of solid end caps and an open structure between the pair of end caps to permit dye to pass through the structure. The open structure includes a plurality of rings arranged axially along the length of the tube and a plurality of rigid ribs extending between the end caps and through the plurality of rings. The open structure is closed and impermeable to dye flow adjacent to each of the end caps to prevent dye "blowout" during processing. In the preferred embodiment, the tube is formed from a homopolymer of polypropylene plastic having an ASTM D-256A notched Izod impact score of greater than or equal to 0.5 ft-lbs/inch, an ASTM D-790A flexural modulus of greater than about 200,000 psi and an ASTM D-648 heat deflection value of greater than about 200° F.

9 Claims, 2 Drawing Sheets

RIGID PLASTIC DYE TUBE

BACKGROUND OF THE INVENTION (1) Field of the Invention

The present invention relates generally to yarn carriers and, more particularly, to a rigid plastic dye tube resistant to both axial and radial compression.

(2) Description of the Prior Art

Dye tubes typically carry packages of about 4½ pounds of yarn per tube. In some cases, the tubes are designed to be compressed axially after the yarn has been wound on the tube to relax the yarn, thereby permitting more uniform dyeing, and to increase the amount of yarn which can be dyed at one time. Increasing the amount of yarn on the tube would save handling and tube costs.

Conventional plastic tubes just are not strong enough to hold higher density yarn packages without collapsing (dumbbelling) due to the tension in the yarn. This is especially evident in situations where a yarn package must be put through the dyeing process a second time to correct defects or to adjust the shade of the yarn. This forces the manufacturer to unroll the yarn onto a new package before the product can be re-dyed.

Previous rigid tubes have not been strong enough to hold enough yarn without cracking. However, the dye tube must be able to carry yarn without disturbing it, thereby permitting all of the yarn on a roll to be removed by automatic machinery. A tube having a cracked surface can not do this.

Thus, there remains a need for a new and improved dye tube which is sufficiently strong to carry a substantially higher density yarn package while, at the same time, does not crack and disturb the yarn.

SUMMARY OF THE INVENTION

The present invention is directed to a rigid dye tube that is designed to carry yarn packages with substantially greater yarn densities than conventional tubes without cracking. The tube includes a pair of solid end caps and an open structure between the pair of end caps to permit dye to pass through the structure. The open structure includes a plurality of rings arranged axially along the length of the tube and a plurality of rigid ribs extending between the end caps and through the plurality of rings. The geometry of the rigid ribs resists compression in both the axial and radial (i.e. circumferential) directions. The open structure is closed and impermeable to dye flow adjacent to each of the end caps to prevent dye "blowout" during processing.

In the preferred embodiment, the tube is formed from a homopolymer of polypropylene plastic. A homopolymer is a polymer formed from a single monomer. One example is polyethylene formed by the polymerization of ethylene. The preferred plastic has an ASTM notched Izod value of greater than 0.5, a flexural modulus of greater than 200,000 psi at 66° F., and a heat deflection value of greater than 200° F.

By using the rigid tube of the present invention, increased yarn density can be obtained, which allows the manufacturer to dye more yarn on each tube. In addition, because the tubes do not crack after the yarn has been wound on them, there is less disturbance of the yarn package. This facilitates the unwinding of the entire yarn package after the yarn has been processed, because the yarn is less likely to become tangled within the package. The present design also facilitates reworking of the yarn, when necessary. Because the tubes are rigid in both the longitudinal and radial directions and does not creep over time, they can be run through the dyeing process more than once.

Accordingly, one aspect of the present invention is to provide a rigid plastic dye tube. The tube includes: (a) a pair of solid end caps; (b) an open structure between the pair of end caps to permit dye to pass through the structure, the structure including a plurality of rings arranged axially along the length of the tube and a plurality of rigid ribs extending between the end caps and through the plurality of rings; and (c) wherein the open structure is closed and impermeable to dye flow adjacent to each of the end caps.

Another aspect of the present invention is to provide a rigid plastic dye tube. The tube includes: (a) a pair of solid end caps; and (b) an open structure between the pair of end caps to permit dye to pass through the structure, the structure including a plurality of rings arranged axially along the length of the tube and a plurality of rigid ribs extending between the end caps and through the plurality of rings, wherein said ribs include radial elements to resist radial compression.

Still another aspect of the present invention is to provide a rigid plastic dye tube. The tube includes: (a) a pair of solid end caps; (b) an open structure between the pair of end caps to permit dye to pass through the structure, the structure including a plurality of rings arranged axially along the length of the tube and a plurality of rigid ribs extending between the end caps and through the plurality of rings, wherein the open structure is closed and impermeable to dye flow adjacent to each of the end caps and wherein said ribs include radial elements to resist radial compression; and (c) wherein the tube is formed from a homopolymer of polypropylene plastic.

These and other aspects of the present invention will become apparent to those skilled in the art after a reading of the following description of the preferred embodiment when considered with the drawings.

DESCRIPTION OF THE PREFERRED EMBODIMENTS

Figure 1:
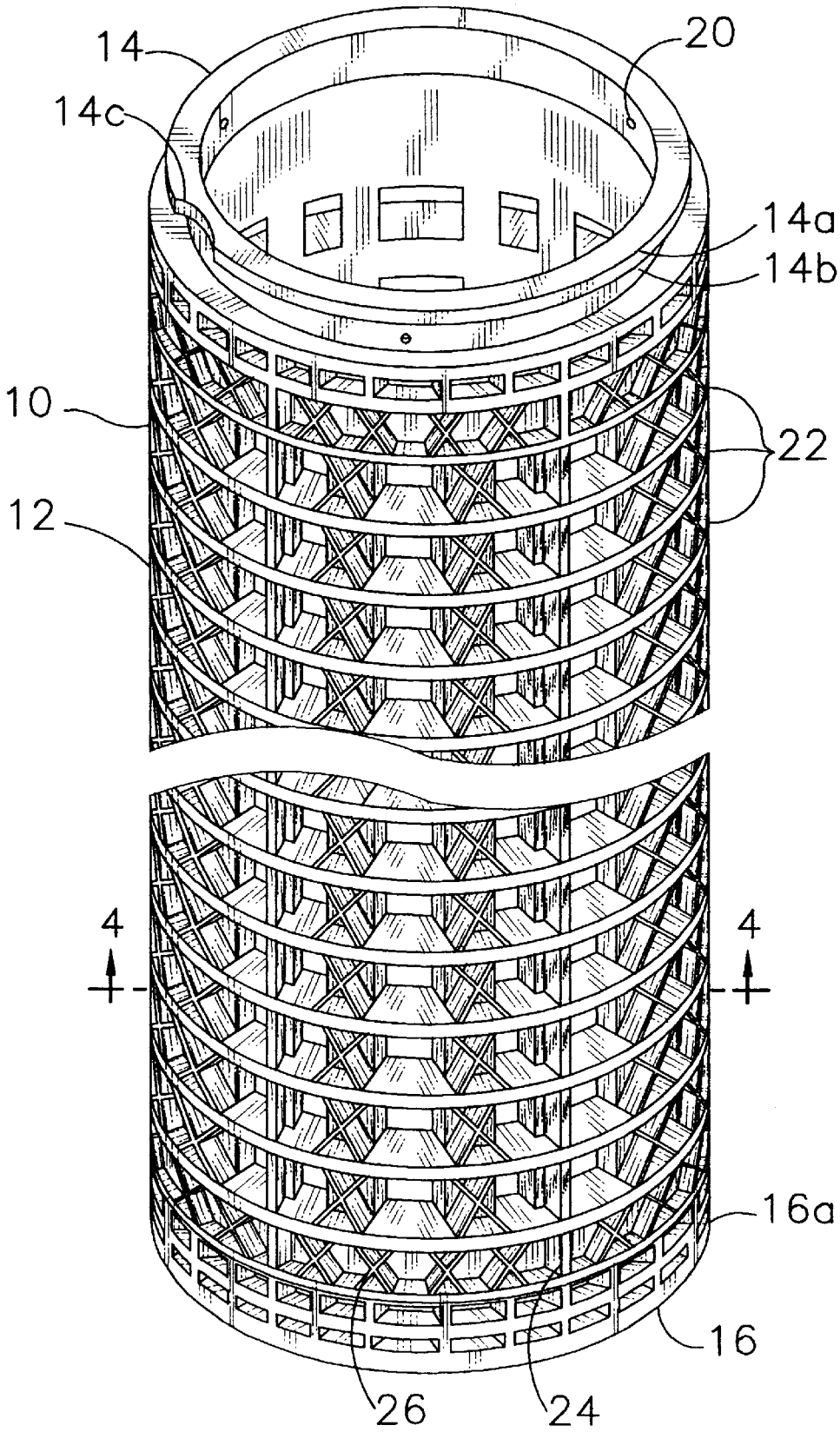
FIG. 1 is a perspective view illustrating a rigid plastic dye tube constructed according to the present invention.
Figure 2:
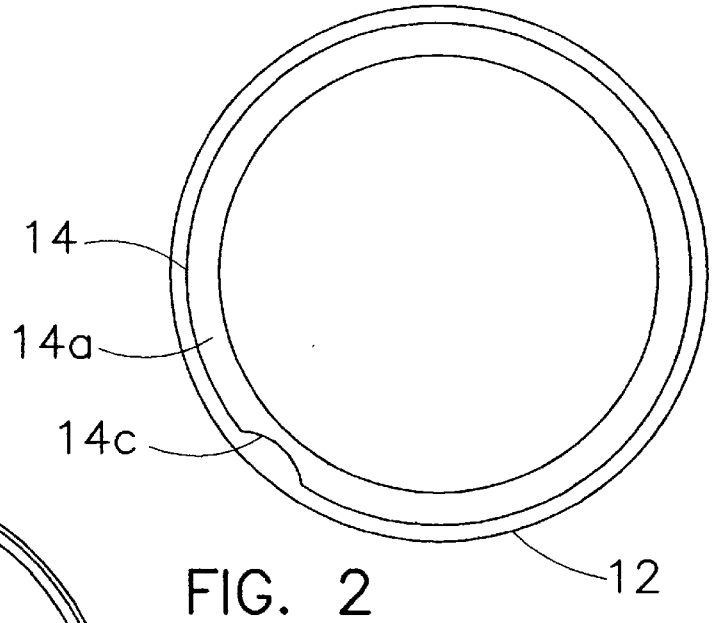
FIG. 2 is a top end view of the dye tube shown in FIG. 1.
Figure 3:
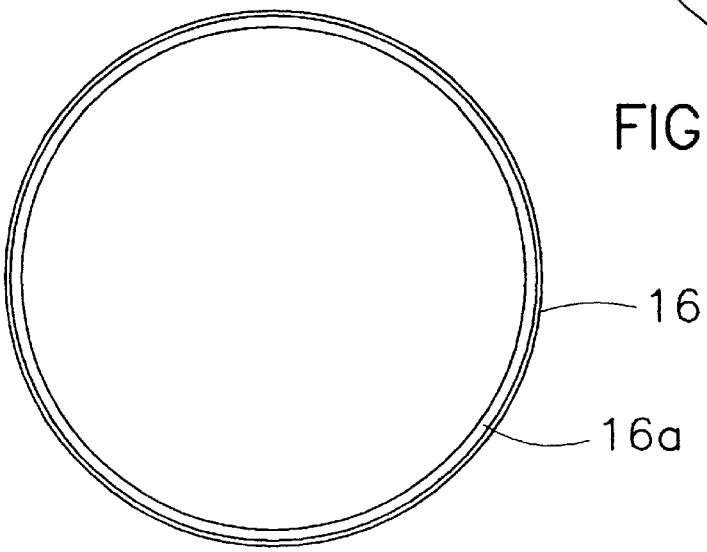
FIG. 3 is a bottom end view of the dye tube shown in FIG. 1.
Figure 4:
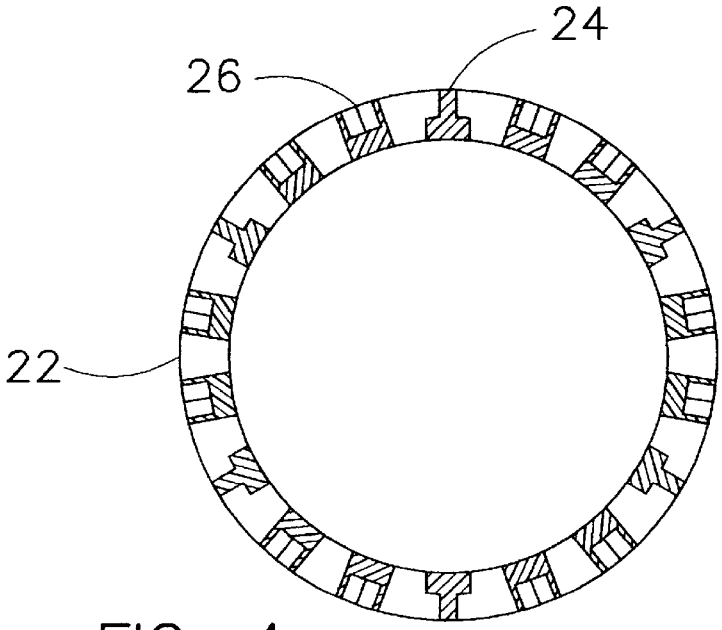
FIG. 4 is a cross-sectional view of the dye tube shown in FIG. 1, taken along line 4-4.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a rigid plastic dye tube, generally designated 10, is shown constructed according to the present invention.

The tube is in the shape of a hollow cylinder 12. The tube has two end caps, a male cap 14 and female cap 16. The end caps are designed so that the male cap 14 of one tube fits snugly within female cap 16 of another tube. This permits the tubes to be stacked on top of each other during the dyeing process.

The male end cap 14 also has one or more openings 20 in its side wall to permit dye liquor to flow into the space between the two end caps in order to dye the transfer tail of yarn that lies in that space. The male end cap 14 has a uniform internal diameter. However, it has a lip 14*a* that has a greater outside diameter than the body wall 14*b*. Therefore, when the male cap is place inside the female cap, a channel is created that is used to retain a transfer tail of yarn. See, for example, U.S. Pat. No. 4,702,433, the entire disclosure of which is hereby incorporated by reference.

The female cap 16 includes a depending skirt 16*a* having an inside diameter at its lower end that is approximately the same as the outside diameter of the lip 14*a* of the male end cap.

Between the two end caps 14 and 16, the body of the tube consists of a plastic cylinder 12. The central area of the cylinder has an open structure made up of rings 22 and linear ribs 24 and 26, with openings between these elements to permit the flow of dye liquor to the yarn wrapped on the tube. The rigid ribs include radial elements to resist radial compression.

The portions of the tube body nearest the end caps are not open; that is, they are solid plastic cylinders that are impermeable to the flow of dye liquor. The rings 22 are spaced at intervals of approximately ½ inch along the length of the tube body. The linear ribs 24 and 26 are spaced at intervals of approximately ½ inch around the circumference of the tube body.

There are two types of linear ribs, T-ribs 24 and X-ribs 26. In the preferred embodiment, six T-ribs 24 and twelve X-ribs 26 are spaced around the tube in a repeating pattern of two X-ribs between each pair of T-ribs.

The preferred embodiment also includes a thumb groove in the upper lip 14*a* of the male end cap 14. The thumb groove is used to permit easy access to the transfer tail after the dyeing process has been completed.

The rigid plastic dye tube of the present invention is formed by an injection molding process. In order to obtain the required rigidity to allow reworking without collapsing or cracking, a specific range of material properties have been found to be required. In the preferred embodiment, the tube preferably is formed from a homopolymer polypropylene sold by Quantum Chemical Corporation of Cincinnati, Ohio under the tradename PP8020-ZU. The preferred material has the desirable qualities of achieving an ASTM D-256A notched Izod impact score of greater than or equal to 0.5 ft-lbs/inch. It also has an ASTM D-790A flexural modulus of greater than about 200,000 psi and an ASTM D-648 heat deflection value of greater than about 200° F. In the configuration of the preferred embodiment, the tube experiences less than about 1.5% longitudinal shrinkage in normal use. It also experiences radial shrinkage of less than about 0.7 mm after 72 hours, which permits the yarn package to be dyed, allowed to shrink, and to be reworked on the spindle of the dye machine several times, if necessary. This avoids the need to unwind the yarn onto another tube if the product needs to be re-processed.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A rigid plastic dye tube, said tube comprising:

(a) a pair of solid end caps;

(b) an open structure between said pair of end caps to permit dye to pass through said structure, said structure including a plurality of rings arranged axially along the length of said tube and a plurality of rigid ribs extending between said end caps and through said plurality of rings, wherein said ribs include radial elements to resist radial compression; and (c) wherein said plurality of rigid ribs are arranged with X-ribs between T-ribs.

2. The dye tube according to claim 1, wherein said plurality of rigid ribs are selected from the group consisting of X-ribs and T-ribs.

3. The dye tube according to claim 2, wherein said plurality of rigid ribs are arranged with two X-ribs between each pair of T-ribs.

4. A rigid plastic dye tube, said tube comprising:

(a) a pair of solid end caps;

(b) an open structure between said pair of end caps to permit dye to pass through said structure, said structure including a plurality of rings arranged axially along the length of said tube and a plurality of rigid ribs extending between said end caps and through said plurality of rings, wherein said open structure is closed and impermeable to dye flow adjacent to each of said end caps and wherein said ribs include radial elements to resist radial compression;

(c) wherein said tube is formed from a homopolymer of polypropylene plastic; and (d) wherein said plurality of rigid ribs are arranged with X-ribs between T-ribs.

5. The dye tube according to claim 4, wherein said plastic has an ASTM D-256A notched Izod impact score of greater than or equal to 0.5 ft-lbs/inch, an ASTM D790A flexural modulus of greater than about 200,000 psi and an ASTM D-648 heat deflection value of greater than about 200° F.

6. The dye tube according to claim 4, wherein said solid end caps include a male end cap and a female end cap.

7. The dye tube according to claim 6, wherein said male end cap includes at least one opening to permit passage of dye through said cap.

8. The dye tube according to claim 4, wherein said plurality of rigid ribs are selected from the group consisting of X-ribs and T-ribs.

9. The dye tube according to claim 8, wherein said plurality of rigid ribs are arranged with two X-ribs between each pair of T-ribs.

* * * * *